US005355650A

United States Patent [19]

Agar

[11] Patent Number: 5,355,650

[45] Date of Patent: Oct. 18, 1994

[54] BATTEN MOUNTING SYSTEM

[76] Inventor: Robert S. Agar, 150-14 Ferrier Street, Markham, Ontario, Canada, L3R 3K3

[21] Appl. No.: 54,709

[22] Filed: Apr. 28, 1993

[51] Int. Cl.[5] ..... E04F 19/02

[52] U.S. Cl. ..... 52/716.1; 52/242

[58] Field of Search ..... 52/716.1, 242, 211–217, 52/738; 49/504, 505, 506

[56] References Cited

U.S. PATENT DOCUMENTS 3,009,549 11/1961 Miller ..... 52/738

3,203,053 8/1965 Lane et al. ..... 52/213

OTHER PUBLICATIONS

Altura Architectural Products Division of Western Extrusions Corporation (Carrollton, Texas) brochure, "ALTURA, Frames for the Future" (publication date unknown, but in Applicants's possession since Jun. of 1991).

Ragland Manufacturing Co., Inc. (Houston, Texas) catalog, "RACO Doors & Frames," pp. 8, 75, and 113 (publication date unknown).

Unistrut Corporation, Unistrut Interior Building Systems Division (North Kansas City, Missouri) brochure, "COLORLINE ® Partition Systems" (publication date unknown, but brochure is marked ©1986 Unistrut Corporation).

*Primary Examiner*—James L. Ridgill, Jr.

*Attorney, Agent, or Firm*—Vaden, Eickenroht, Thompson, Boulware & Feather

[57] ABSTRACT

In a demountable office partition system, batten mounts with a base and legs of a resilient hard plastic are snap fit to supporting structures by reason of inwardly directed opposed flanges on the legs. The legs of the batten mounts also have soft plastic externally directed fingers to which a batten may be press fit. Use of the batten mounts permits the batten to be removed without damage. In another embodiment, the base of the batten mounts have a first set of depending inner legs with inwardly directed flanges and a second pair of depending outer legs with outwardly directed flanges outwardly spaced from the inner legs. The batten mount is fabricated of a resilient hard plastic. Again, the batten mounts may be snap fit to a supporting structure. However, in this embodiment, a batten is snap fit to the batten mounts. The batten may be removed from the batten mount without damage due to the resilience of the outer legs.

14 Claims, 4 Drawing Sheets

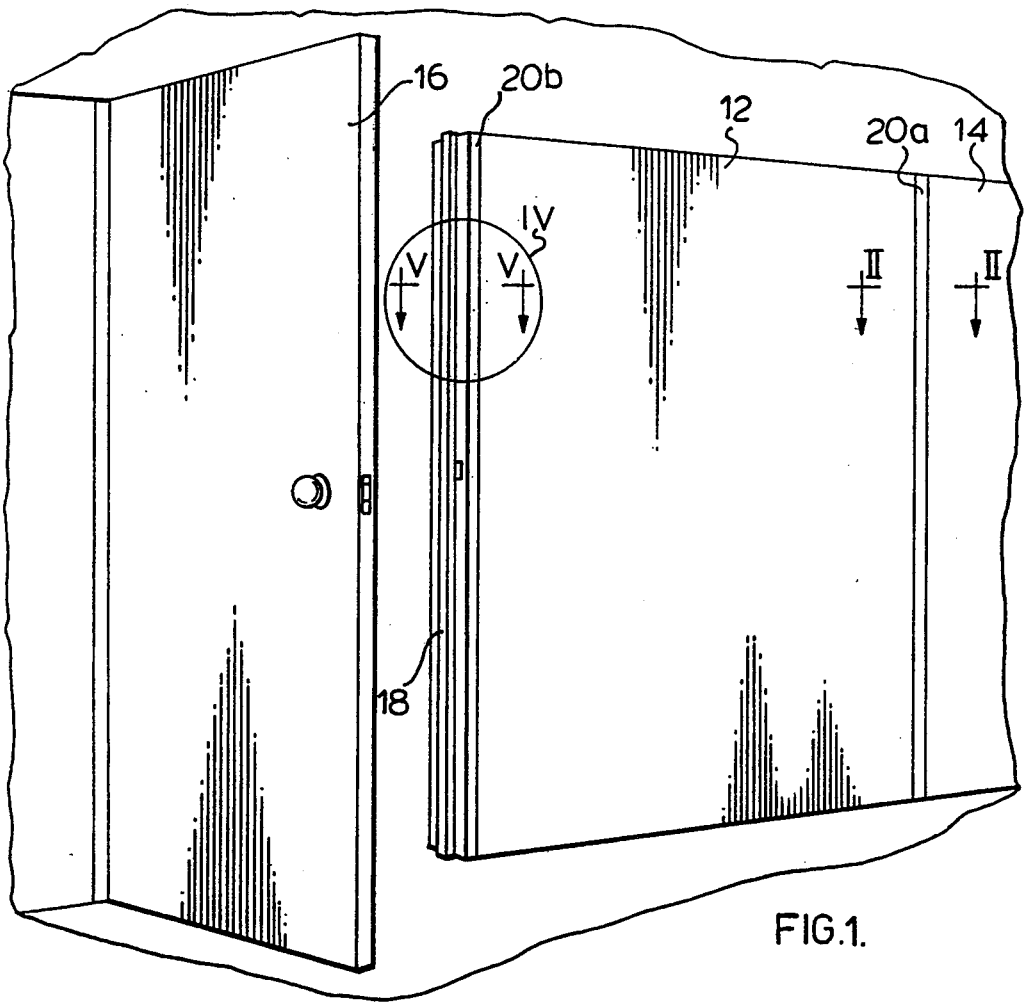
FIG.1.
FIG.5
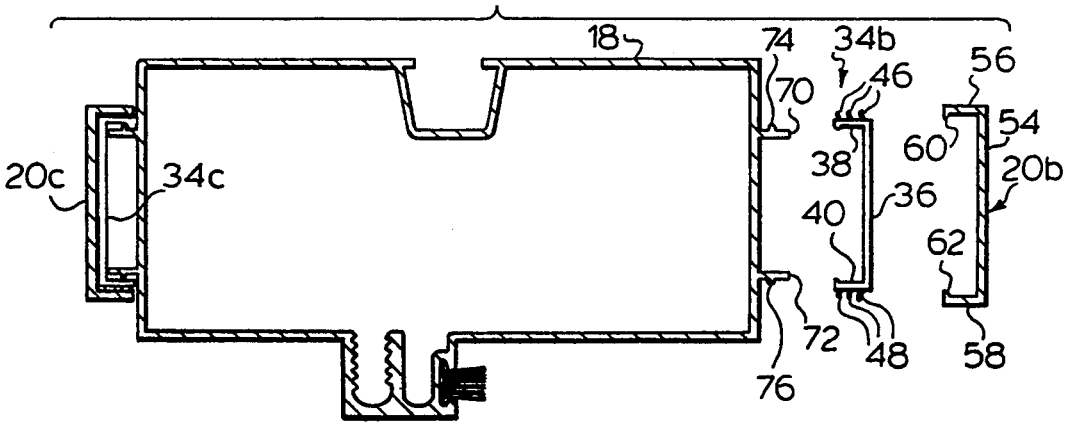

BATTEN MOUNTING SYSTEM

BACKGROUND OF THE INVENTION

1. Field of the Invention

This invention relates to a batten mount and to a system for mounting a batten.

2. Description of the Related Art

In the demountable office partition industry, seams between wall partitions are often hidden by first affixing a support strip along the seam having longitudinally extending legs with outwardly directed flanges. A batten having legs with inwardly directed flanges may then be snap fit to the support strip. To provide a finishing strip at door lintels, which may cover screws securing the lintel to a wall partition, similar battens may be snap fit to flanged legs extending longitudinally along the lintels.

For reasons of economy, the size of battens, support strips and door lintels with spaced flanged legs are standardised. The battens, support strips and lintels may be fabricated from aluminium or plastic. Where they are made from aluminum, they are die extruded. With use, the dies wear, usually at different rates because different amounts of each component are used for various jobs, such that the dimensions of the battens, support strips and lintels during a production run change. The practical result is that some aluminum battens fit loosely on the supporting legs of a support strip or lintel such that the installer must either screw the batten to the support strip or lintel or use adhesive or various types of tapes to affix the batten to the strip or lintel and others fit very tightly and must be driven on with a mallet. When it is desired to demount a partition, the battens must be removed. Where the batten is aluminum and makes a tight fit with its supporting legs, it is invariably destroyed when removed. In the case of loose-fitting battens which have been affixed to the strip or lintel with screws, the screw holes render the batten unsuitable for re-use and if an adhesive or tape was used to secure a loose batten, the adhesive or tape must be removed (often a difficult and uneconomical operation) to be able to re-use the batten. This necessitates obtaining new battens when the partition is re-used.

This invention seeks to overcome drawbacks in the prior art.

SUMMARY OF THE INVENTION

According to the present invention, there is provided a batten mount comprising the following: a base; a pair of legs depending from said base with inwardly directed opposed flanges; said base and said depending pair of legs with inwardly directed flanges having sufficient resilience for permitting snap fitting of said pair of legs with opposed flanges to a supporting structure; a pair of legs depending from said base with outwardly directed flanges for releasably engaging a batten.

According to another aspect of the invention, there is provided a system for releasably mounting a batten comprising the following: a supporting structure having a pair of legs with outwardly directed flanges extending along its length; a plurality of batten mounts positioned intermittently along the length of said supporting structure, each batten mount having a base; a pair of legs depending from said base with inwardly directed opposed flanges snap fit to said supporting structure; and a pair of legs depending from said base with outwardly directed flanges; a batten having a base and a pair of depending legs with inwardly directed opposed flanges, said batten releasably secured to said supporting structure by said outwardly directed flanges of said plurality of batten mounts.

BRIEF DESCRIPTION OF THE DRAWINGS

In the figures which disclose example embodiments of the invention,

FIG. 1 is a perspective view of a demountable partition system made in accordance with this invention, FIG. 5 is a partially exploded cross-sectional view along the lines V—V of FIG. 1.

DESCRIPTION OF THE PREFERRED EMBODIMENTS

With reference to FIG. 1, a demountable partition system comprises wall partitions 12, 14, door 16 and door lintel 18. The seam between the wall partitions 12, 14 is covered by a batten 20*a*. A batten 20*b* acts as a finishing strip on lintel 18.

Figure 2:
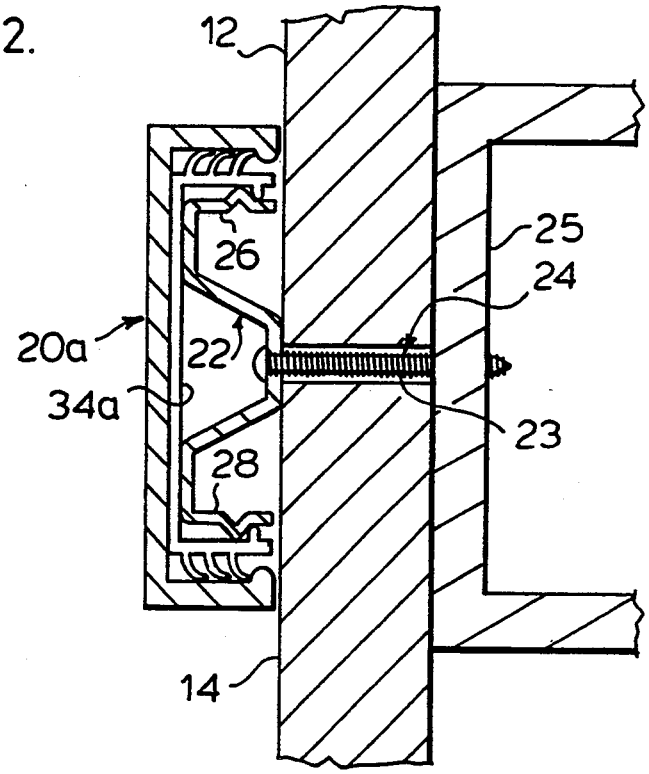
FIG. 2 is a cross-sectional view along the lines II—II of FIG. 1.
Figure 3:
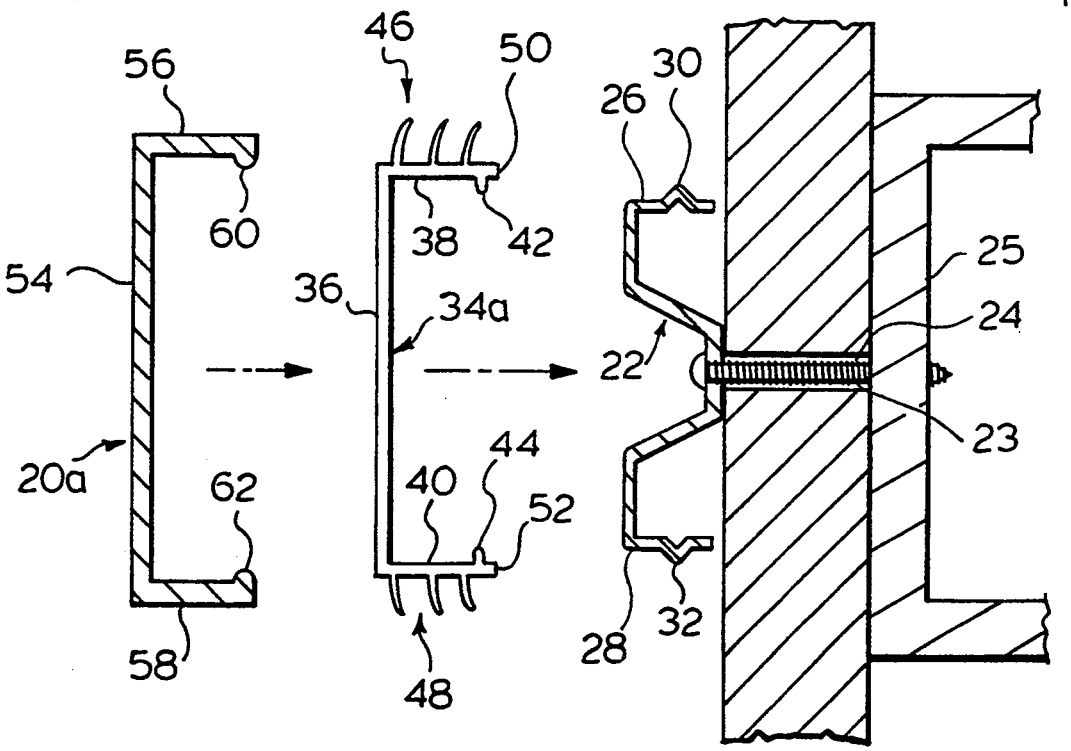
FIG. 3 is an exploded cross-sectional view of the embodiment of FIG. 2.

With reference to FIGS. 2 and 3, a support strip 22 is fastened by screws 23 to stud 25 at the seam 24 between wall partitions 12 and 14. The support strip has a pair of legs 26, 28 with a outwardly directed flange 30, 32 extending along the length of each leg. A number of batten mounts 34*a* are positioned intermittently along the length of the support strip. Each batten mount has a base 36 with a pair of legs 38, 40 depending from the base. Batten mount legs 38, 40 have inwardly directed opposed flanges 42, 44, respectively and outwardly directed flanges or fingers 46, 48, respectively. There is a plurality of outwardly directed flanges 46 or 48 on each leg 38, 40 and the outwardly directed flanges are angled toward the free ends 50, 52, respectively, of the legs.

The batten mount base 36 and depending legs 38, 40 are fabricated of a hard plastic that has sufficient resilience to allow the opposed flanges 42, 44 to snap fit over the outwardly directed flanges 30, 32 of the supporting strip 22. The outwardly directed flanges 46, 48 are fabricated of a soft plastic so that the outwardly directed flanges are more compliant than the batten mount base 36 and depending legs 38, 40. This may be achieved by co-extruding the batten mount from two materials.

Batten 20*a* has a base 54 and a pair of depending legs 56, 58 with inwardly directed opposed flanges 60, 62. The batten may be press fit over the batten mounts on support strip 22 which, as seen in FIG. 2, collapses the outwardly directed flanges 46, 48 and frictionally joins the batten to the batten mounts.

Figure 4:
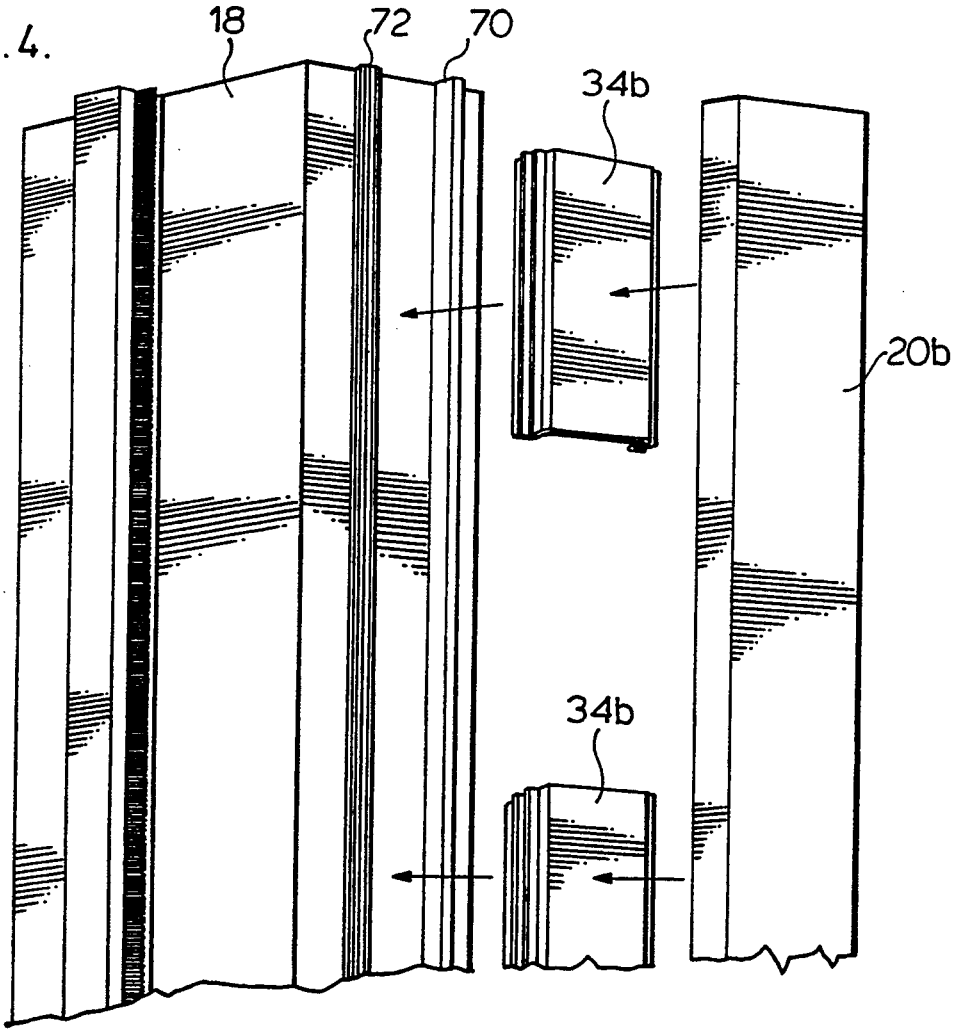
FIG. 4 is an exploded enlarged view of the area IV of FIG. 1.

With reference to FIGS. 4 and 5, door lintel 18 has a pair of legs 70, 72 extending along its length with a pair of outwardly directed flanges 74, 76. A number of batten mounts 34*b* are snap fit to the lintel legs along the length of the lintel. Batten mounts 34*b* are identical to batten mounts 34*a* of FIGS. 2 and 3. A batten 20*b*, which is identical to batten 20*a* of FIGS. 2 and 3, is press fit over the batten mount. As seen in FIG. 5, the opposite side of the lintel has a further pair of legs to which is snap fit batten mounts 34*c* and a batten 20*c* is press fit to these batten mounts.

Figure 6:
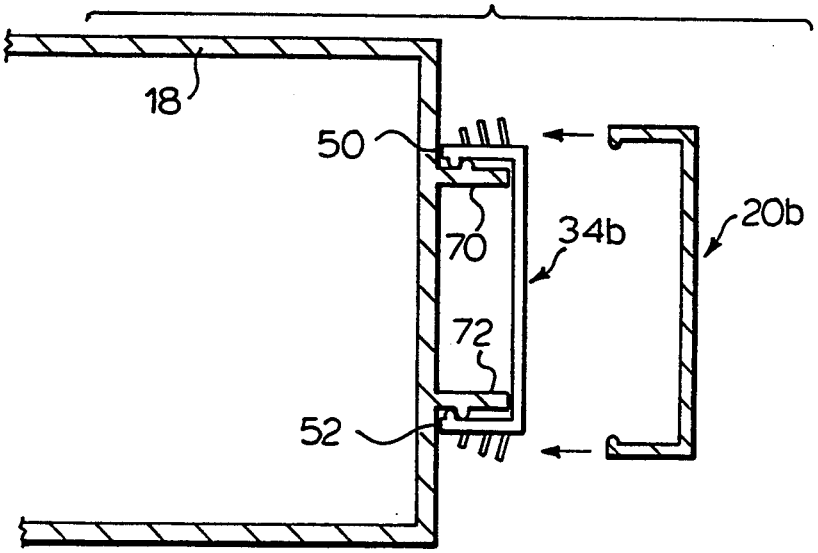
FIG. 6 is a further partially exploded cross-sectional view.

The operation of the batten mounting system is illustrated in FIGS. 4 and 6. A plurality of batten mounts 34*b* are first snap fit to the legs 74, 76 of the lintel 18, as seen in FIG. 6. As indicated in FIG. 4, the batten mounts are spaced along the length of the lintel. Next, batten 20*b* is press fit to the batten mounts; because the fingers 46, 48 are angled toward the free ends 50, 52 of the legs of the batten mount, these fingers collapse in the direction of the lintel which minimizes the stress on the fingers. The similar manner of putting up a batten between wall seams is described in conjunction with FIGS. 2 and 3. After wall partitions 12, 14 are set up, a support strip 22 is mounted to wall partition 12 by screws 23. Thereafter, a number of batten mounts 34*a* may be snap fit along the length of the support strip. Subsequently, batten 20*a* may be press fit over the outwardly directed flanges 46, 48 of the batten mounts 34*a* in order to secure the batten to the support strip.

When it is desired to take down the partition system, the battens may be pulled from the batten mounts. The compliance of the outwardly directed flanges 46, 48 facilitates removal without damage to the battens, even where the battens are fabricated of aluminum. The screws 23 holding the support strips 22 may then be removed without the need to demount the batten mounts 34*a*. This is for the reason that there are gaps between the batten mounts so that these mounts may be slid up or down on the legs of the support strip if necessary in order to expose screws 23. Similarly, if the battens on the door lintel cover screws, such screws may also be removed without the need to demount the batten mounts 34*b*, 34*c* from the lintel.

It will be apparent that variations in the inside dimensions of battens due to dimensional tolerances may be accommodated by the compliance of the outwardly directed flanges 46, 48.

Figure 7:
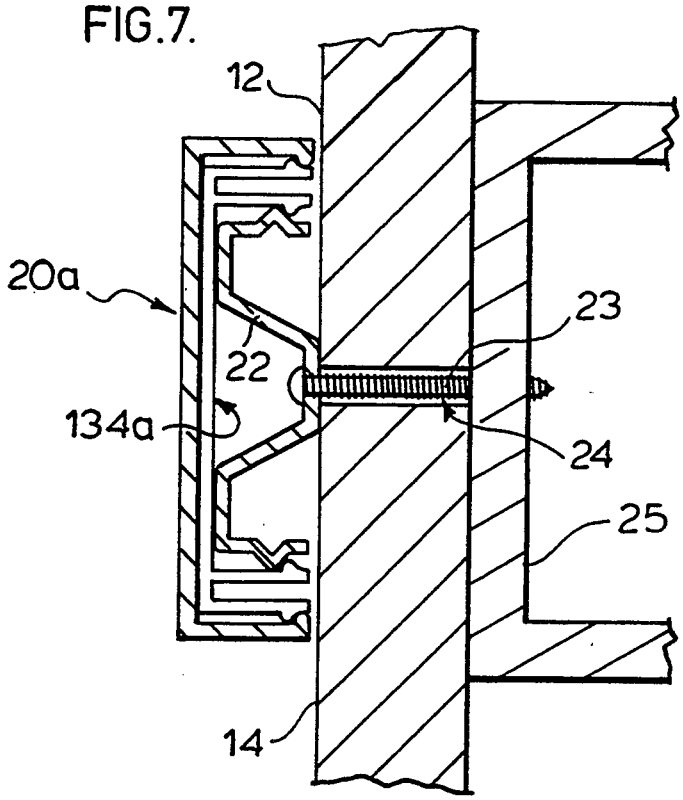
FIG. 7 is a cross-sectional view of an alternate embodiment of the invention.
Figure 8:
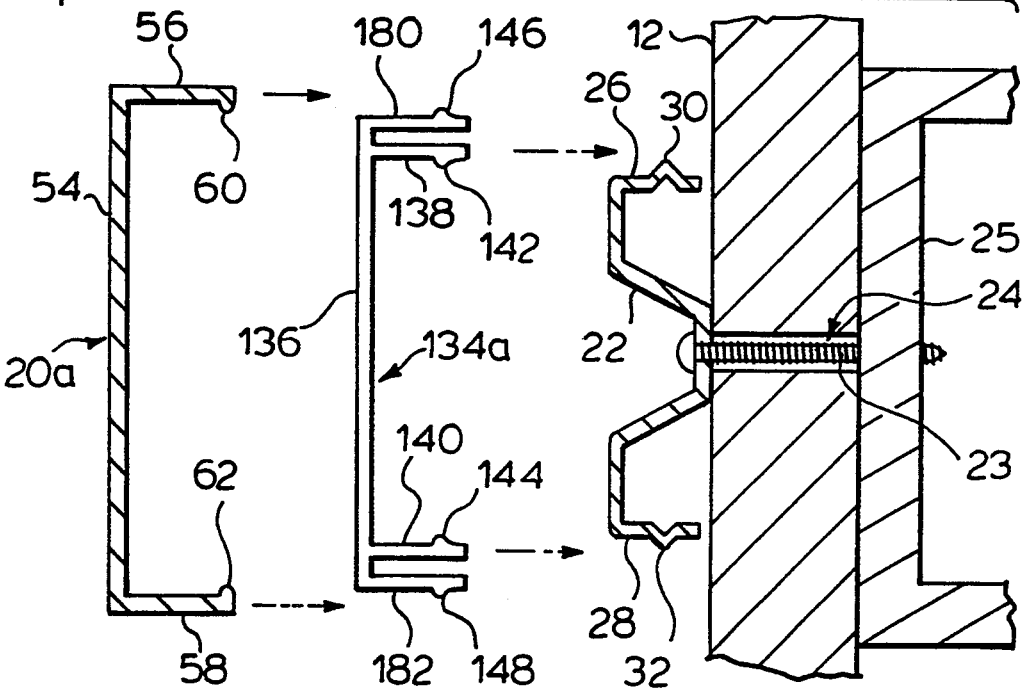
FIG. 8 is an exploded cross-sectional view of the embodiment of FIG. 7.

FIGS. 7 and 8 illustrate an alternative embodiment of the invention. Turning to these figures, wherein like parts have been given like reference numerals, batten mount 134*a* has a base 136 and a pair of depending legs 138, 140 with inwardly directed flanges 142, 144. A second pair of depending legs 180, 182 also depends from base 136 and is outwardly spaced from legs 138, 140. Each of legs 180, 182 has an outwardly directed flange 146, 148, respectively. Batten mount 134*a* is fabricated of a hard plastic that has sufficient resilience to allow the opposed flanges 142, 144 to snap fit over the outwardly directed flanges 30, 32 of the supporting strip 22 and to allow the legs 180, 182 to be deflected. In operation, the inner legs 138, 140 with their inwardly directed flanges 142, 144 of the batten mount 134*a* are snap fit to support strip 22. A batten 20*a* is then snap fit to the outer legs 180, 182 with their outwardly directed flanges 146, 148. Because outer legs 180, 182 depend from base 136 and are spaced from inner legs 138, 140, the outer legs have a sufficient resilience to permit removal of the batten without damage despite the expected dimensional tolerances of the batten.

Other modifications will be apparent to those skilled in the art and, accordingly, the invention is defined in the claims.

What is claimed is:

1. A batten mount for releasably joining a batten to a supporting structure comprising the following:

a base;

first and second legs depending from said base;

means formed in each of said first and second legs and projecting inwardly therefrom for snap fitting of said base and said first and second legs to a supporting structure;

outwardly directed flanges formed on each of said first and second legs for releasably engaging a batten, said outwardly directed flanges being formed of a more compliant material than said base, said first and second legs, and said snap fitting means.

2. The batten mount of claim 1 wherein said outwardly directed flanges are angled toward a free end of said pair of legs.

3. The batten mount of claim 2 wherein each leg of said pair of legs has a plurality of said outwardly directed flanges.

4. A batten mount comprising the following:

a base;

a pair of legs depending from said base having inwardly directed opposed flanges formed thereon; said base and legs having sufficient resilience for permitting snap fitting of said inwardly directed flanges to a supporting structure;

each leg of said pair of legs having at least one resilient outwardly directed finger;

each outwardly directed finger being fabricated of a more compliant material than said base and said pair of legs so that the resilient outwardly directed fingers may releasably mount a batten.

5. A co-extruded batten mount comprising the following:

a base with a pair of legs depending therefrom having inwardly directed opposed flanges extruded from a resilient hard plastic, said legs with opposed inwardly directed flanges for snap fitting to a supporting structure;

at least one resilient outwardly directed flange co-extruded to each of said pair of legs from a resilient soft plastic for releasably mounting a batten.

6. A batten mount comprising the following:

a base;

a pair of inner legs depending from said base with inwardly directed opposed flanges formed on each of the inner legs;

said base and the inner legs being fabricated of plastic having sufficient resilience for permitting snap fitting of the flanges on each of the inner legs to a supporting structure;

a pair of outer legs depending from said base, each of said outer legs being spaced outwardly of the inner legs;

each of said outer legs having an outwardly directed flange formed thereon; and said outer legs being fabricated of plastic having sufficient resilience for permitting a batten to be releasably snap fit thereto.

7. A system for releasably mounting a batten comprising the following:

an elongate supporting structure having a pair of legs with outwardly directed flanges extending along its length;

a plurality of batten mounts positioned intermittently along the length of said supporting structure, each of said batten mounts having a base; a pair of legs depending from said base with inwardly directed opposed flanges snap fit to said supporting structure; and a pair of legs depending from said base with outwardly directed flanges formed thereon, the outwardly directed flanges being fabricated of a more compliant material than said base and said pair of legs; and a batten having a base and a pair of depending legs with inwardly opposed flanges, said batten being releasably secured to said supporting structure by the outwardly directed flanges of said plurality of batten mounts.

8. The system of claim 7 wherein, for each of said plurality of batten mounts, each leg of said pair of legs with outwardly directed flanges is outwardly spaced from said pair of legs with inwardly directed flanges.

9. The batten mount of claim 7 wherein said outwardly directed flanges are angled toward a free end of said pair of legs.

10. The batten mount of claim 9 wherein each leg of said pair of legs is provided with a plurality of said outwardly directed flanges.

11. A batten mount for releasably joining a batten to a supporting structure comprising the following:

a base;

a first pair of legs depending from said base and having flanges formed thereon for engaging a supporting structure, said first pair of legs being formed of a material having sufficient resilience for permitting snap fitting of the flanges formed thereon to the supporting structure; and a second pair of legs depending from said base and spaced along said base from said first pair of legs, said second pair of legs having flanges formed thereon for engaging a batten and being formed of a material having sufficient resilience for permitting the batten to be releasably snap fit thereto.

12. The batten mount of claim 11 wherein said second pair of legs is spaced along said base outwardly of said first pair of legs.

13. The batten mount of claim 12 wherein the flanges formed on said second pair of legs are comprised of a material which is more compliant than the material comprising said base and said first and second pairs of legs.

14. The batten mount of claim 13 wherein said more compliant material is co-extruded to said second pair of legs.

* * * * *